US007357727B2

(12) United States Patent
Back

(10) Patent No.: US 7,357,727 B2
(45) Date of Patent: Apr. 15, 2008

(54) AUTO RACE TRACK DESIGN

(76) Inventor: Brian Back, 234 Cliff Dr., #14, Laguna Beach, CA (US) 92651

( * ) Notice: Subject to any disclaimer, the term of this patent is extended or adjusted under 35 U.S.C. 154(b) by 0 days.

(21) Appl. No.: 10/190,047

(22) Filed: Jul. 3, 2002

(65) Prior Publication Data

US 2004/0003749 A1 Jan. 8, 2004

(51) Int. Cl.
*A63K 1/00* (2006.01)
*A63K 3/00* (2006.01)

(52) U.S. Cl. ..... 472/85; 472/92; 104/60; 104/63

(58) Field of Classification Search ..... 472/85, 472/88, 89, 92; 104/53, 60, 55, 63
See application file for complete search history.

(56) References Cited

U.S. PATENT DOCUMENTS

| | | | | |
|---|---|---|---|---|
| 809,588 | A | 1/1906 | Thomas et al. | |
| 846,207 | A * | 3/1907 | Jackman | 104/63 |
| 877,993 | A | 2/1908 | Georges | |
| 920,346 | A | 5/1909 | Kronenberger | |
| 925,818 | A * | 6/1909 | Mangels | 104/60 |
| 1,806,102 | A * | 5/1931 | Traver | 104/63 |
| 1,999,052 | A * | 4/1935 | Kennedy | 463/62 |
| 2,146,631 | A * | 2/1939 | Kish | 472/85 |
| 3,238,854 | A | 3/1966 | Okubo | |
| 4,172,593 | A | 10/1979 | Palakanis | |
| 5,645,368 | A | 7/1997 | Yunick | |
| 5,800,272 | A * | 9/1998 | Pons | 472/85 |

* cited by examiner

*Primary Examiner*—Kien Nguyen
(74) *Attorney, Agent, or Firm*—Terry L. Miller

(57) ABSTRACT

A racetrack designed to accommodate various types of auto racing class including Indy, CART, Formula 1 etc. is disclosed. The race track of the present invention is a continuous closed circuit track with at least two loops which loop about a common center area and with track passing over itself at least once by a nonlevel crossing such as an overpass so that the track does not have a level crossover and thereby allowing a vehicle making an entire circuit of the track the option of only making turns in one direction and not passing over any portion of the track more than once is a single circuit of the track.

11 Claims, 7 Drawing Sheets

AUTO RACE TRACK DESIGN

FIELD OF THE INVENTION

The present invention relates to automobile racetracks and their design and more particularly to automobile racetrack designs that are capable of accommodating several different types of automobile racing.

BACKGROUND OF THE INVENTION

When auto racing started in Europe at the beginning of the 1900's it generally took place through the countryside on standard roads. This tradition has continued down to the present with the typical European auto race taking place on a road type of circuit. On the other hand in the United States at the beginning of the 1900's auto racing started on run-down horse racing tracks. This tradition has substantially continued to the present with the typical auto race venue being on a dedicated oval circuit with some exceptions. Additionally, professional auto racing of various types has become multibillion-dollar sport/entertainment industry.

Over the years auto racing has fragmented into several different forms, which in many respects are or may become mutually exclusive. A number of the major variations are Formula 1 (F-1) (A privately owned, Europe based, international series running formula autos on road circuits), Championship Auto Racing Teams (CART, a publicly traded U.S. based corporation that sponsors an international series running formula autos on road, street, oval and mixed circuits.) and National Association of Stock Car Auto Racers (NASCAR), (Privately owned, U.S. based, National Series Running "stock" cars on 99% oval mix and 2% road circuits).

One of the more recent fractures in auto racing occurred in the mid-1990's when the Indianapolis Motor Speedway (IMS) and CART parted ways, leading to the creation of the Indy Racing League (IRL), (A privately owned, U.S. based, National series running formula cars on a variety of oval mix circuits). Given the fact that sponsors, fans and contracts with broadcast outlets are limited the more fractured the sport becomes the less it will be able to sustain the concentration of money and fans necessary for the sport to survive and thrive.

As noted the IRL Series confines their racing to an oval type racetrack when the car moves around the oval in one direction and makes each turn in only one direction. Racing on oval tracks began on horse tracks and since horses' raced in a counter clockwise direction with only left turns modern auto racing continues this tradition. The cars in this type of racing are thus designed to turn only to the left during the race and consequently a number of mechanical, structural and aerodynamic design features of this form of racing machine are intended to optimize the operation of the car and the safety of the driver under the conditions for racing on an oval circuit in one direction.

Presently, CART incorporates a more flexibly designed car suitable for racing on oval, street or road circuits and where there are turns to both the left and right. The fissure between CART and IMS resulted in part from IMS mandated requirements regarding engine power and design, and chassis rules for the INDY 500 (An IMS Corp., Race) in order to slow the cars down. At the time of this fissure CART had 20 other races in its series and was locked into engine contracts that specified engines which did not meet the engines design mandated by IMS's. CART'S powerful engines were too fast for IMS thus CART and IMS parted ways. IMS started its own series, the IRL, with a more restrictive engine formula in order to slow the speeds down on ovals. CART went on its way without the INDY 500 as its showcase event while IMS with the establishment of IRL continued developed its own series of events.

Since CART cars do not have the design limitations mandated by IRL they can achieve higher speeds than IRL cars. However, this fact in itself causes problems in that on some racetracks, in particular oval ones. CART cars can reach speeds of over 240 miles per hour. Since the turns of the typical high performance oval racetrack are steeply banked the cars can enter the curves at speeds of 240 miles per hour or more. At these speeds the driver experiences forces equivalent to two to three G's, similar to that experienced by jet fighter pilots, only in a different direction, i.e. laterally. Thus in a race on an oval track in which a car completes one circuit of the track in a half a minute or less the driver may experience these forces two or three times over the course of half a minute. From experience it has been determined that an individual undergoing periodic G forces more frequently than every 40 to 50 seconds will have a tendency to black out. Additionally, G-suits used by fighter pilots are useless in a racing car since a pilot only experiences an up and down force while that experienced by a racing car driver also to the side, lateral.

The situation become so bad that on Apr. 29, 2001 the President of the CART had to cancel a race, the Firestone Fire hawk 600, scheduled at the Texas Motor Speedway. During trials the drivers were experiencing excessive G forces in the turns and there was a fear that in the drivers attempts to perform at maximum possible speeds some of the drivers might black out with catastrophic consequences. Texas Motor Speedway like many other oval tracks have high-banked corner's that allow the cars to maintain their maximum speeds in the turns. Additionally the Texas Motor Speedway had no straights of significant length to give the drivers a break. Drivers were thus experiencing G forces a majority of the time in each lap. On the other hand although IMS has long straights it has tow-banked 90-degree corners with no runoff but the drivers are still able to maintain speed without lifting off the throttle.

Although street courses can be set up to inhibit the speed at which CART autos run at they usually provide a spectator only a limited view of the race unlike an oval track which usually allows a spectator a view of substantially most of the race. Additionally, street courses lack the efficiency and crowd control features of an oval track. Since one of the purposes of auto racing is to make money for its promoters and participants oval or enclosed tracks that allow for optimal crowd placement and control are much more desirable than open road courses. Typically, several different types of racecourses can be placed inside the confines of an oval track including a street type of course for Formula 1 racing. However, one of the limitations of an oval track are the limited design options for IRL racing autos which are designed to turn in one direction during a race, to the left.

Given present design techniques available for oval auto racecourses and the need to limit turns to one direction around the entire course the options available for IRL type of tracks are severely limited. Most oval courses are limited in total acreage and if made too big in area Lose the advantage associated with an oval track. Only so many turns can be introduced into an oval course and then it simply becomes a circular course.

Thus, what is needed is some means to reverse the effects of fragmentation within auto racing and allow each of the different racing series to compete at the same facility, but not on the same circuit. Such a racecourse would have the advantage of limiting all turns to the left for certain types of races while increasing the distance and number of corners of the track, much like a road course.

SUMMARY

It is an objective of the present invention to provide a multifunction racecourse; one that most if not all forms of auto racing can be conducted. It is an additional objective to provide a racetrack on which the speed of the cars can be controlled to avoid having the drivers exposed to excessive and prolonged G-forces. It is still another objective of the present invention to provide a racetrack design that can be easily retrofitted on to existing racetracks.

The present invention accomplishes these and other objectives by providing a racetrack design that includes one exterior complete closed circuit and at least one interior loop, the at least one interior loop connecting to the exterior closed circuit at two points, the exterior closed circuit and at least one interior loop being configured such that a racer can make a continuous movement starting from and returning to the same point by moving around substantially all of the closed circuit and all of the loop while making turns in only one direction and the loop includes at least one overpass so that the one continuous movement by the racer can be made without touching any portion of the at least one loop and the closed circuit more than once before passing the start tine a second time.

BRIEF DESCRIPTION OF THE DRAWINGS

The invention wilt be better understood by an examination of the following description, together with the accompanying drawings, in which.

DETAILED DESCRIPTION OF THE PREFERRED EMBODIMENT

Figure 1:
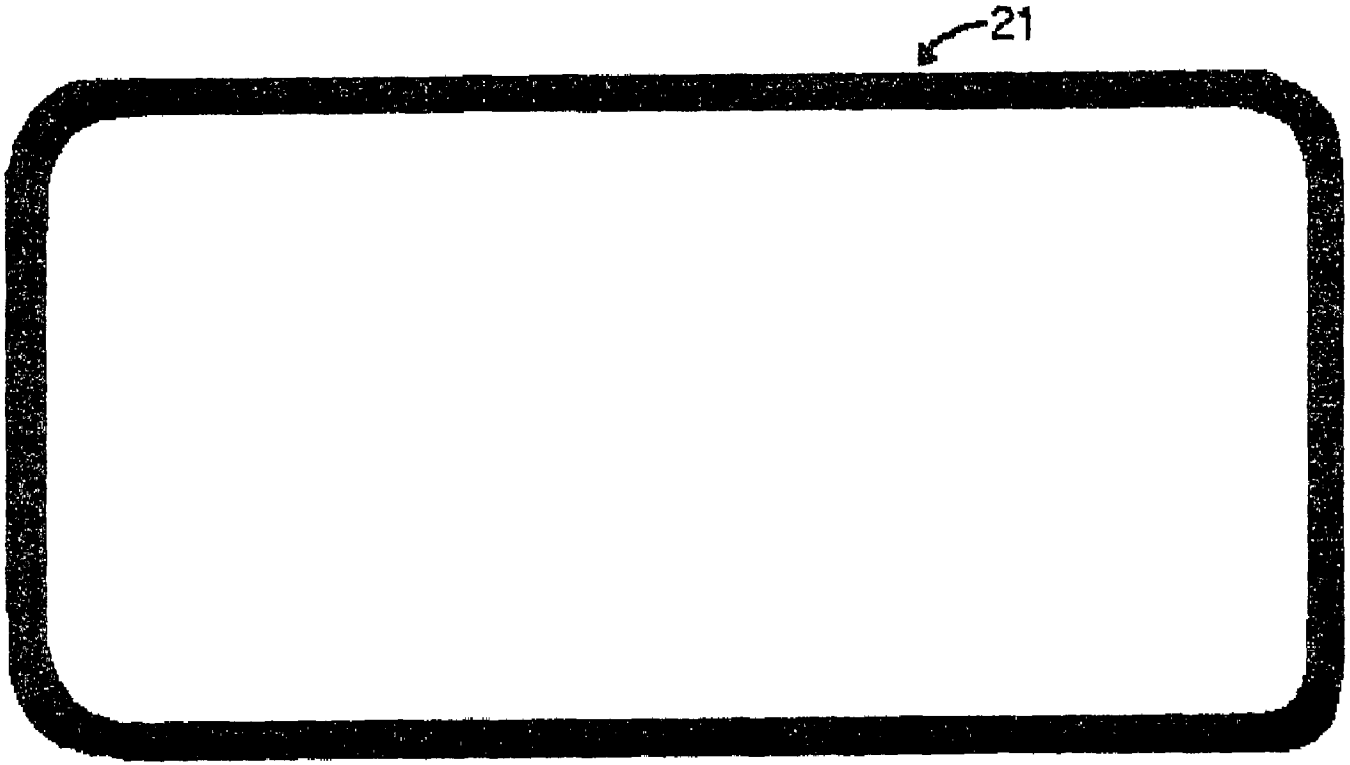
Prior Art Fig. 1
FIG. 1 depicts a prior art oval racetrack.
Figure 2:
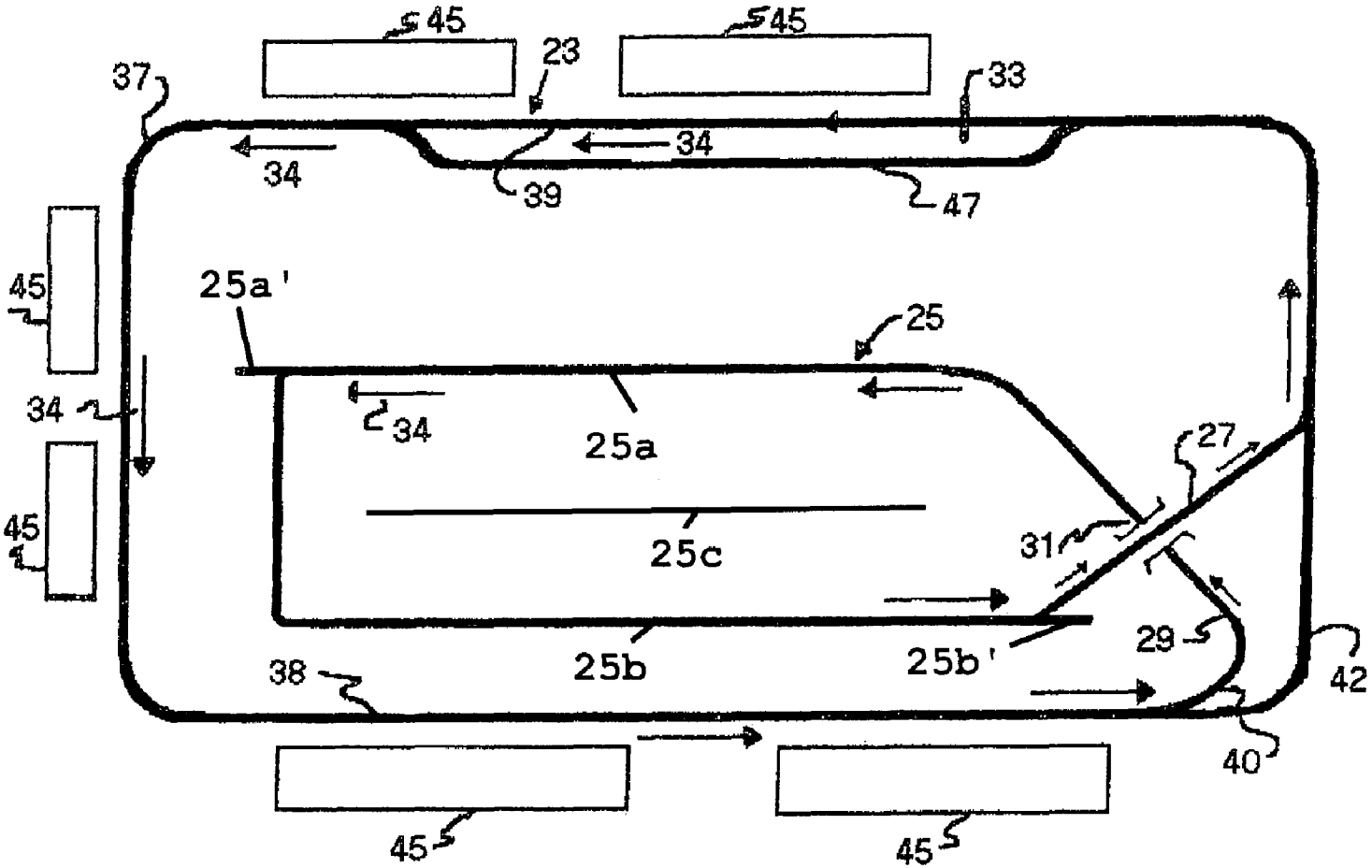
FIG. 2 depicts a racetrack made according the present invention.

The present invention provides a design for a racecourse that incorporates unique design elements that allow for the incorporation of the best features of both IRL course requirements but with a flexibility that allows for the racing of CART type of cars in a controlled speed environment. The present invention does this by adding at least one underpass or bridge on the racecourse to allow the track to turn back or loop back on itself. The use of a bridge or underpass, i.e. a nongrade or nonlevel crossing, and thus avoids a grad crossing giving the cars the ability to move over the entire course without stopping. FIG. 1 depicts a very basic prior art oval racecourse 21 with four turns. FIG. 2 depicts a racecourse made according to the present invention that is set up with an outer oval 23 and inner oval 25. Roads 27 and 29 connect the outer oval 23 and inner oval 25 with a crossover at 31. The crossover is either a bridge or underpass to avoid a level crossing. The start of a race might be at 33 and the flow of the race could follow the arrows 34 around the track. As can be seen all of the turns the racecars would make during the race would be to the left around the track. Naturally, it is possible to reverse the direction and make all of the turns to the right. Having the turns all go in one direction meets one of the major requirements of IRL type of cars.

One of the advantages of this set up of the racetrack according to the principles of the present invention is that a variety of straight-aways of varying lengths and turns at various positions can be incorporated into the design of the racetrack. This type of setup will allow for the control of the speed of the cars. The setup depicted in FIG. 2 allows only one very high-speed turn at 37 that the cars reach after passing down the Long opening straightaway 39. The rest of the turns either do not have an approach straightaway Long enough to gain maximum speed or the approach straightaway ends at a very sharp turn that requires the car to slow down substantially. The advantage of this aspect is that it limits the track to one turn in which the driver will experience substantial G-forces. The other long straightaway 38 ends in a sharp turn 40 that require the racing car driver to slow down significantly to make the turn. The racetrack depicted in FIG. 2 provides two different racecourses. The first being around the entire out side oval 23 including section 42. The second racecourse is around the inside oval 25 and the outside oval 23 with the exception of section 42 of the outside oval. Thus, one could safely run IRL racing cars around the first racecourse the entire outside oval and CART, Formula 1 and IRL racing cars around the second racecourse consisting of most of the outer oval 23 and all of the inner oval 25.

Further viewing FIG. 2, it is seen that the outside oval 23 and the inside oval 25 are both elongate along an axis, which is illustrated by the line 25*c* for convenience. Inside oval 25 includes a long straightaway 25*a*, aligned with and somewhat adjacent to straightaway 23, and also includes a long straightaway 25*b* aligned with and somewhat adjacent to straightaway 38. At the end of straightaway 25*a*, the inside oval 25 includes a runoff section of pavement, indicated with numeral 25*a*'. Similarly, at the end of straightaway 25*b*, the inside oval 25 includes a runoff section of pavement indicated with numeral 25*b*'. Importantly, both the outside oval 23 and the inside oval 25 are elongate along the length of line 25*c*, and the cross over or overpass 31 is disposed at an end of the inside oval 25, and is also disposed adjacent to (although inside of) an end of the outside oval 23. This arrangement of the racecourse seen in FIG. 2 has an advantage in that the cross over 31 is in each case (i.e., whether a race car is moving from the inside to the outside oval or vice versa) immediately preceded by a corner which requires the automobiles competing on the racecourse to slow down before proceeding to and crossing the cross oVer 31. This disposition of the cross over 31 at an end of the elongate ovals of road surface and immediately preceded by a slowing corner vastly improves the safety of the racecourse at the cross over feature.

Figure 3A:
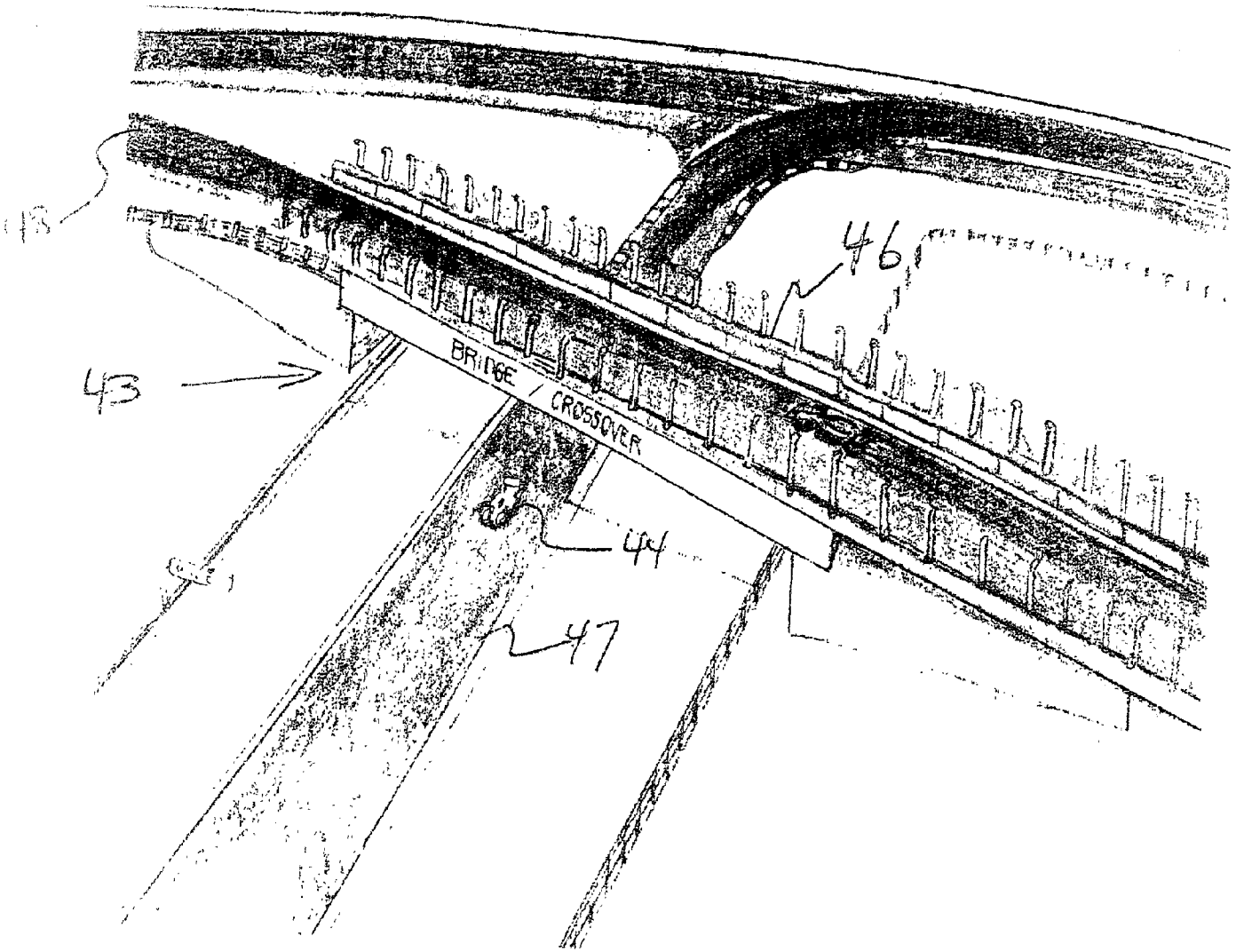
FIG. 3A depicts a raised view of a crossover or overpass that allows the racetrack of the present invention to pass over itself in a nongrade crossing.
Figure 3B:
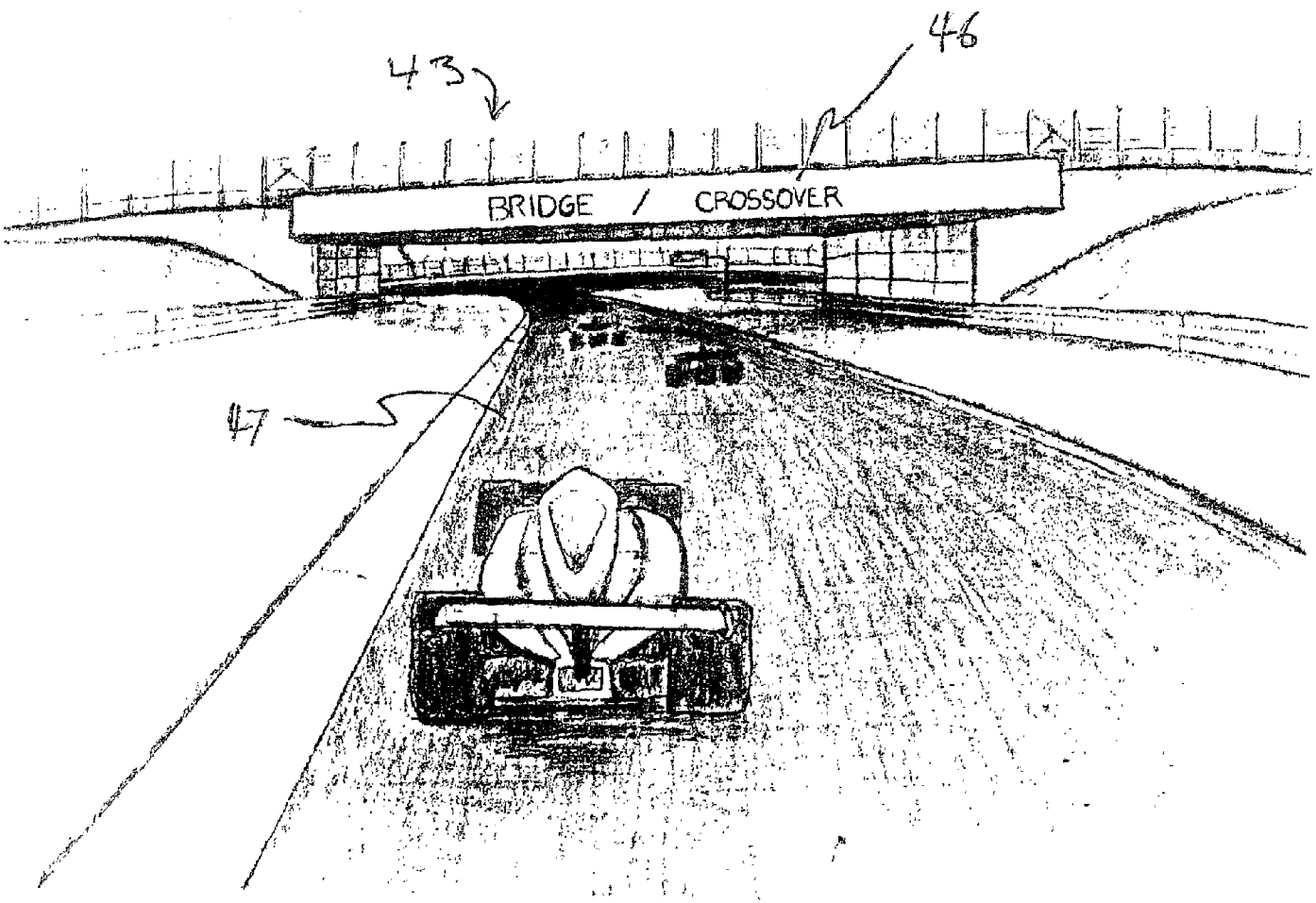
FIG. 3B depicts a lower roadway view of a crossover or overpass that allows the racetrack of the present invention to pass over itself in a nongrade crossing.

FIG. 3A provides a view of a crossover 43 of the present invention. The crossover is a bridge, overpass or underpass that allows the racetrack to loop back on itself without the need of a grad crossing. This arrangement allows the racecars to move continuously around the track and not have to periodically stop for traffic. The crossover can be a typical concrete or metal bridge. A car 44 on lower roadway 47 has just passed under the bridge 46 of over pass 43. FIG. 3B provides a view from lower roadway 47 of overpass 43 and bridge 46 that forms the overpass.

A racetrack constructed according to the present invention would be made with a concrete roadway. The roadway will be banked at a number of the important turns while some of the sharper turns will not be banked much at all to provide for control the speed of the cars during the race. The present description, other than describing the set of the racecourse, does not include a detailed discuss of the construction of a racetrack since those skilled in the art, once they read and understand the principles of the present invention, will be able to construct a racetrack according to the present invention based on generally known racetrack construction principles.

One of the key features of the present invention is that the ovals 23 and 25 of the track progressively turn in towards a common center as depicted in FIG. 2. Thus, an existing oval racetack could be easily modified to incorporate the present invention without the need for expanding onto more land. The infield of the existing track would be used for the added oval or ovals as the case maybe. In fact the track set up depicted in FIG. 2 could be very easily retrofitted onto an existing oval racetrack. The original oval of the racetrack being oval 23 and the new oval being oval 25 with roadway section 27 and 29 connecting the two ovals. Naturally, crossover 31 would be included to complete the racecourse. The outside oval 23 on a typical racecourse might be 2.6 miles or 4.2 kilometers in total circumference. Thus, the addition of an interior loop or oval 25 might add from three quarters of a mile to 1.5 miles to the entire racecourses. One of the unique advantages of the present invention is that spectators sitting in typical racetrack grandstands 45 located around the periphery of the outside oval 23 will be able to see a significant portion of the race on both the inside and outside ovals 23 and 25. Additionally, there will still be enough room for the pit stop area 47.

Since the racecourse of the present invention can be constructed within the parameters of a typical oval racetrack the operators of a racetrack of the present invention will be able to exercise good crowd control and be able to tightly control access to races conducted on the racecourse. In fact there would not have to be any modification of existing systems of crowd control or control of access.

Figure 4:
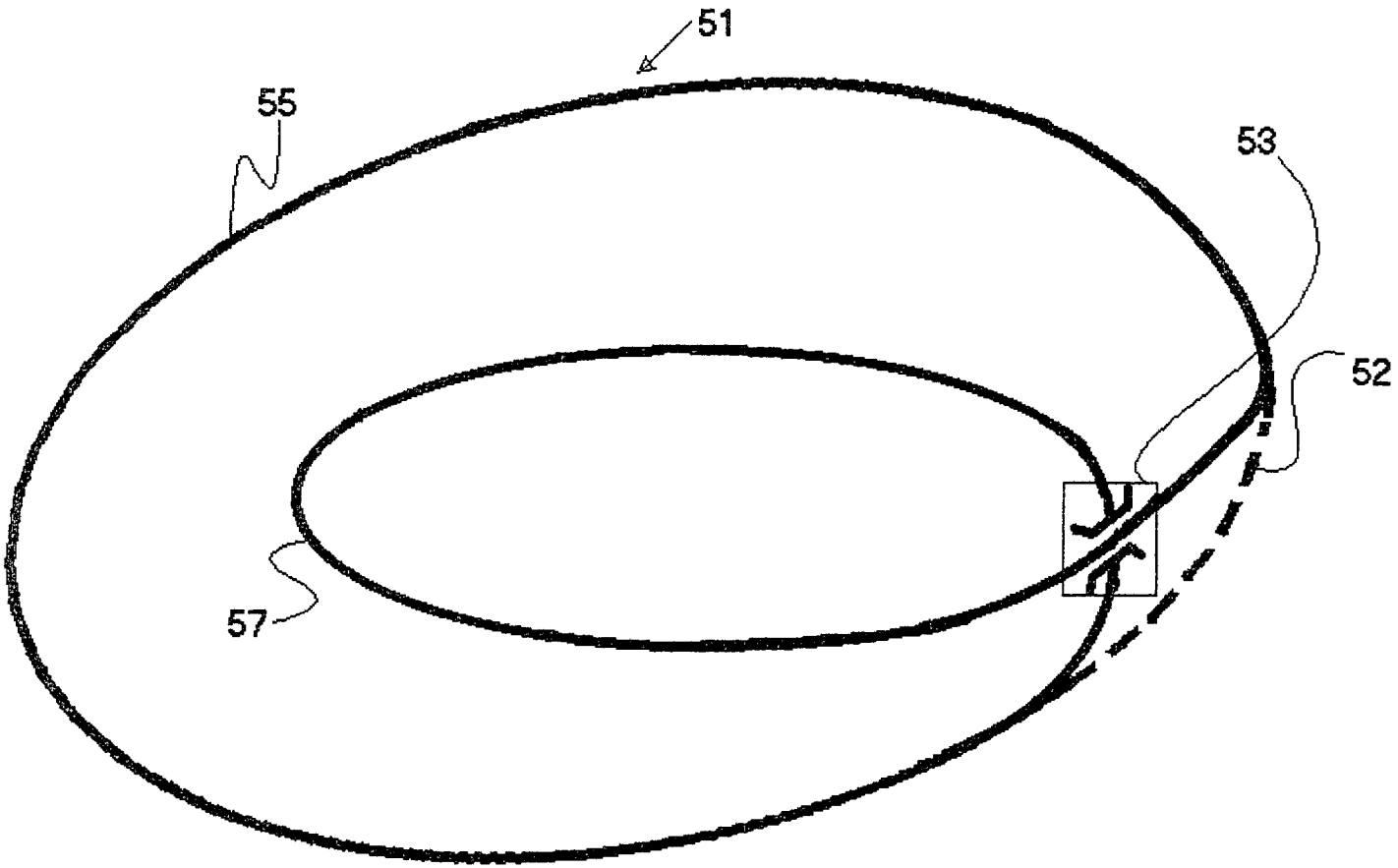
FIG. 4 depicts an inverted figure eight variation of the racetrack of the present invention.

FIG. 4 shows a variation of the racecourse of the present invention in the form of an inverted figure eight 51. Racecourse 51 includes a crossover or overpass 53. Racecourse 51 has outer loop 55 and inner loop 57. Additionally, by adding roadway 52 it becomes a modified figure eight design.

Figure 5:
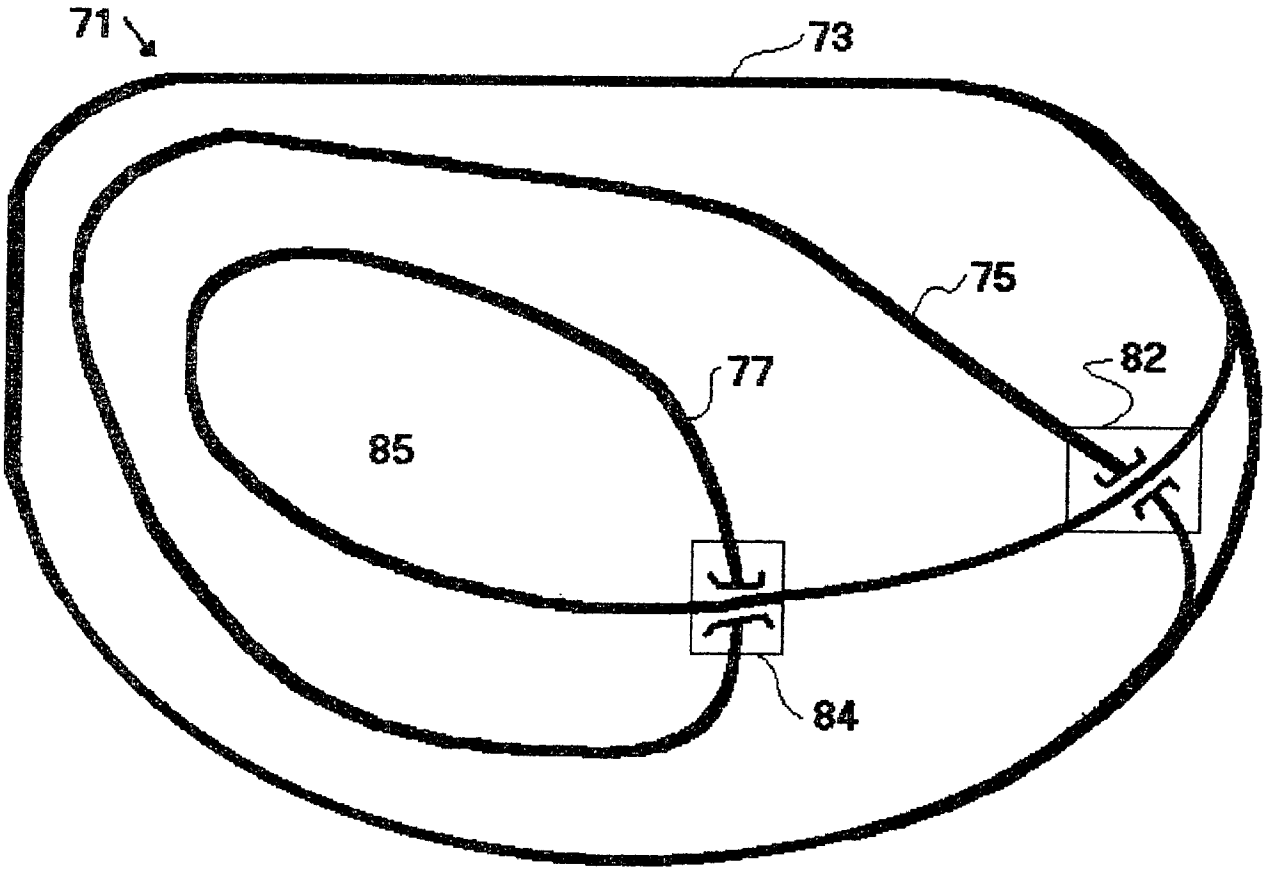
FIG. 5 depicts a variation of the racetrack of the present invention with two crossovers and two additional ovals.

FIG. 5 shows yet another variation of the present invention in which the racecourse 71 has one outer oval 73 and two inner ovals or loops 75 and 77. In this configuration the racecourse 71 has two crossovers or overpasses 82 and 84 to allow the racecourse to pass over itself and avoid a grad crossing. As can be seen all three ovals or loops 73, 75 and 77 have a common center area 85.

Figure 6:
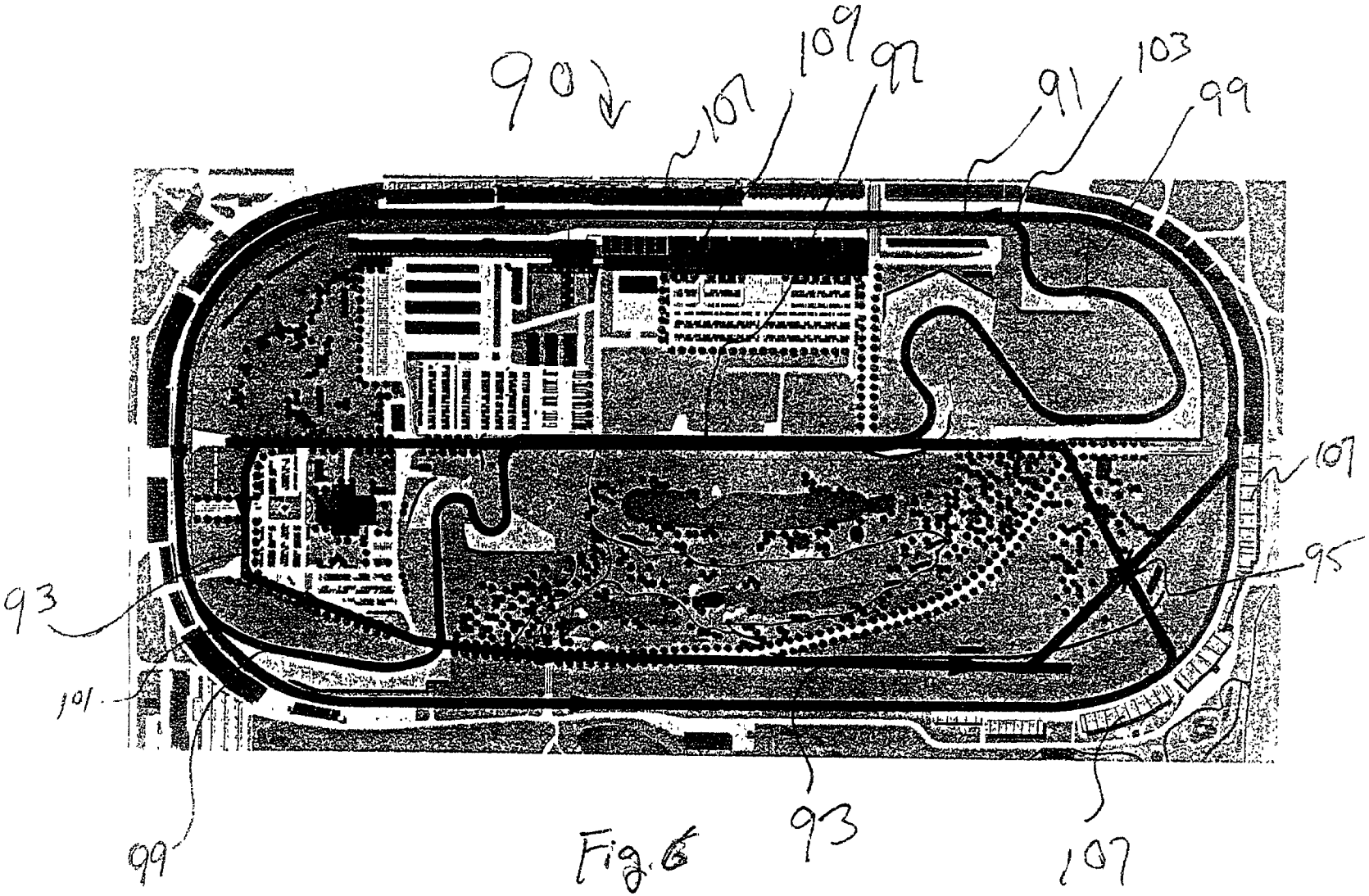
FIG. 6 depicts another version of the racetrack of the present invention.

FIG. 6 provides a variation of the present invention on which just about all forms of auto racing could be run including CART, IRL, Formula One, NASCAR and drag racing. The racetrack 90 includes an outside oval 91 an inside oval or loop 93 with a crossover 95. However, the racecourse also includes one long center straightaway 97 that could be used for drag racing. Also, racetrack 90 includes a meandering portion of the racecourse 99 that starts from outside oval 91 at point 101 and rejoins outer oval 91 at point 103.

This meandering course together with oval could form the basis of a Formula One course. Inner oval 93 and outer oval 91 could form IRL and CART racecourses. Additionally, outer oval 91 could form a NASCAR racecourse. Racetrack 90 has the standard grandstands 107 located around the outside periphery of outer oval plus the standard pit areas 109.

While the invention has been particularly shown and described with reference to a preferred embodiment thereof, it will be understood by those skilled in the art that various changes in form and detail may be made to it without departing from the spirit and scope of the invention.

I claim:

1. A double-loop, closed-course race track for simultaneous competition thereon by plural engine-powered racing automobiles each individually under control of a driver riding thereon, said race track comprising an elongate double-loop of road defining a continuous elongate competition road surface having a pair of spaced apart opposite side edges and being everywhere wide enough between said side edges to accommodate at least two racing automobiles side-by-side so that passing of a racing automobile by another is possible everywhere on said competition road surface in order to facilitate competition thereon, and said competition road surface further being both open, un-interrupted and continuous between said pair of side edges so that each racing automobile may use the entire competition road surface as well as being continuous about a complete lap of said competition road surface, and said elongate competition road surface defining at least two loops each looping about a common central area, and at a dual-level overpass/underpass feature said competition road surface crosses itself at least once without intersecting itself; wherein said road surface defines a plurality of loops about said common area, and further including a plurality of dual-level features whereat said plurality of loops cross one another without intersecting.

2. The race track of claim 1 wherein said road surface is further configured so that a complete lap of said road surface in a selected direction requires a racing automobile to make only right-hand or only left-hand turns.

3. The race track of claim 1 further including said road surface at said dual-level overpass/underpass feature defining one of an over-pass or an under-pass.

4. The race track of claim 1 wherein said road surface defines at least one exterior loop about said common area, and also defines at least one interior loop about said common area, said interior loop and said exterior loop being everywhere spaced from one another except at said dual-level feature, and at said dual level feature a racing automobile circulating on said road surface passes between said interior and said exterior loops.

5. The road of claim 1 wherein said road surface defines an inverted figure "8" with one loop of the figure "8" inverted within the other loop of said figure.

6. A method of providing a double-loop, closed-course race track for simultaneous competition thereon by plural engine-powered racing automobiles each individually under control of a driver riding thereon while also reducing the land-use requirements for the race track, said method comprising steps of:

providing an elongate double-loop of road defining a continuous elongate competition road surface;

configuring said competition road surface to have a pair of spaced apart opposite side edges and being everywhere wide enough between said side edges to accommodate at least two racing automobiles side-by-side so that passing of a racing automobile by another is possible everywhere on said competition road surface in order to facilitate competition thereon;

configuring said competition road surface to be both open, un-interrupted and continuous between said pair of side edges so that each racing automobile may use the entire competition road surface as well as being continuous about a complete lap of said competition road surface;

providing for said elongate competition road surface to define at least two loops each looping about a common central area; and providing for said competition road surface to pass across itself at least once at a dual-level overpass/underpass feature without intersecting itself; further including the steps of utilizing said elongate road surface to define a plurality of loops about said common central area, and further including in said road surface a plurality of dual-level underpass/overpass features whereat said plurality of loops cross one another without intersecting.

7. The method of claim 6 further including the steps of configuring said elongate road surface so that a complete lap of said road surface in a selected direction requires a racing automobile to make only right-hand or only left-hand turns.

8. The method of claim 6 further including the steps of configuring said elongate road surface at said dual-level underpass/overpass feature to define one of an over-pass or an under-pass.

9. The method of claim 6 further including the steps of configuring said elongate road surface to define at least one exterior loop about said common area, and to also define at least one interior loop about said common area, providing for said interior loop and said exterior loop of said elongate road surface to be everywhere spaced from one another except at said dual-level underpass/overpass feature, and providing at said dual level underpass/overpass feature for a racing automobile circulating on said road surface to pass between said interior loop and said exterior loop of said elongate road surface.

10. The method of claim 6 further including the step of configuring said elongate road surface to define an inverted figure "8" with one loop of the figure "8" inverted within the other loop of said figure.

11. A double-loop, closed-course race track for simultaneous competition thereon by plural engine-powered racing automobiles each individually under control of a driver riding thereon, said race track comprising two elongate double-loops of road together defining a continuous elongate competition road surface having a pair of spaced apart opposite side edges and being everywhere wide enough between said side edges to accommodate at least two racing automobiles side-by-side so that passing of a racing automobile by another is possible everywhere on said competition road surface in order to facilitate competition thereon, and said competition road surface further being both open, un-interrupted and continuous between said pair of side edges so that each racing automobile may use the entire competition road surface as well as being continuous about a complete lap of said competition road surface, and said elongate competition road surface defining at least two nested elongate loops each having a common direction of elongation and looping about a common central area, and at one end of an inner one of said two nested elongate loops and adjacent to and inside of an outer one of said two nested elongate loops said race track including a dual-level overpass/underpass feature at which said competition road surface passes across itself at least once without intersecting itself, wherein said road surface is further configured so that a complete lap of said road in a selected direction requires an automobile to make only right-hand or only left-hand turns, and whereby at said dual-level underpass/overpass feature said road surface defines an upper level and a lower level which are sufficiently spaced apart vertically to define a clearance allowing multiple racing automobiles to use the entire road surface at the same time without intersection; wherein said inner loop of road surface includes a runoff feature of pavement generally aligned with a straightaway portion of said inner loop of road surface.

* * * * *